US009079637B2

(12) United States Patent
Sarnowski et al.

(10) Patent No.: US 9,079,637 B2
(45) Date of Patent: Jul. 14, 2015

(54) ANGLED DRAIN PORT WITH PLUG

(71) Applicant: GEM Products, Inc., Orange Park, FL (US)

(72) Inventors: Jason Sarnowski, Jacksonville, FL (US); Erle Matthew Bridgewater, St. Johns, FL (US)

(73) Assignee: Gem Products, Inc., Orange Park, FL (US)

( * ) Notice: Subject to any disclaimer, the term of this patent is extended or adjusted under 35 U.S.C. 154(b) by 53 days.

(21) Appl. No.: 14/026,048

(22) Filed: Sep. 13, 2013

(65) Prior Publication Data

US 2015/0075415 A1 Mar. 19, 2015

(51) Int. Cl.
*B63B 13/00* (2006.01)

(52) U.S. Cl.
CPC ..... *B63B 13/00* (2013.01)

(58) Field of Classification Search
CPC ..... B63B 13/02; B63B 13/00
See application file for complete search history.

(56) References Cited

U.S. PATENT DOCUMENTS

| | | | | |
|---|---|---|---|---|
| 1,285,931 | A | | 11/1918 | Cady |
| 1,866,643 | A | | 7/1932 | Greear |
| 2,997,975 | A | | 8/1961 | Moeller |
| 3,188,994 | A | * | 6/1965 | Dawson ..... 114/197 |
| 3,353,428 | A | | 11/1967 | Herr |
| 3,757,726 | A | * | 9/1973 | Moeller ..... 114/183 R |
| 4,492,392 | A | * | 1/1985 | Woods et al. ..... 285/119 |
| 5,197,567 | A | | 3/1993 | Rabalais |
| 5,727,820 | A | * | 3/1998 | Thompson ..... 285/139.2 |
| D451,468 | S | | 12/2001 | Tobias |
| 6,390,007 | B1 | | 5/2002 | Walker |
| 7,946,238 | B2 | | 5/2011 | Colsher et al. |

* cited by examiner

*Primary Examiner* — Edwin Swinehart
(74) *Attorney, Agent, or Firm* — Seyfarth Shaw LLP

(57) ABSTRACT

A drain plug including a first handle on an interior side of a boat and a second handle on an exterior side of the boat, allowing the drain plug to be operated from an exterior side of the boat or from the interior side of the boat. The handles are also sized to prevent passage through a drain port to prevent the drain plug from being lost. The drain port in which the drain plug is disposed may be angled to provide for clearance between the first handle of the drain plug and the hull of the boat and enable a user to easily grasp the interior handle of the drain plug to install and uninstall the drain plug by hand.

12 Claims, 2 Drawing Sheets

ANGLED DRAIN PORT WITH PLUG

TECHNICAL FIELD OF THE INVENTION

The present invention relates to drain plugs for watercraft. Particularly, the present invention relates to an angled drain plug for boats and other watercraft that includes a plug to prevent unwanted leakage and backflow.

BACKGROUND OF THE INVENTION

In general, most boats and other watercraft include a drain port and removable drain plug for draining water and other fluid that may accumulate in a bottom of the boats. Current drain ports include a body mounted through the transom of the boat with a drain plug that is removable from an exterior side of the boat. The drain plug typically has a mechanism, such as a tether, to keep it from falling or getting lost when uninstalled, but this mechanism is typically not permanent and subject to failure.

Often the drain plug retaining mechanism fails, causing the drain plug to be lost. This creates a hazard because if the boat is in the water without the drain plug, water will enter the bilge freely, which could cause the boat to sink if it is not removed from the water immediately. Moreover, current drain plugs can only be loosened and removed from an exterior side of the boat. Thus, once the boat is in the water there is no way to access the back of the boat to reinstall the drain plug, without a person entering the water to gain access to the drain port. This can especially be a problem in the case where the drain plug is not reinstalled before the boat is put into the water. Additionally, many boats are stored on a lift at a dock, which limits access to the drain plug. This limited access can make is difficult to install and uninstall the drain plug, which can cause water to remain in the bilge, causing problems if the bilge is not properly emptied.

SUMMARY OF THE INVENTION

The present invention relates to an angled drain plug that can be disposed in a drain port of a boat, and can be opened/uninstalled and closed/installed from both the interior and exterior sides of the boat. This angled drain plug cures the issues described above with reference to the current drain plugs on the market.

The drain plug disclosed in the present application includes a first handle on an interior side of the boat and a second handle on an exterior side of the boat. This provides a drain plug that can be installed or uninstalled from the exterior side of the boat, for example, when the boat is on a trailer, or from the interior side of the boat, when the boat is on a lift or in the water. The dual handle also prevents the drain plug from being lost because neither handle can pass through the opening of the drain port in which the drain plug is disposed.

The drain port in which the drain plug is disposed may also be angled to provide for clearance between the first handle or interior handle of the drain plug and the hull of the boat. This enables a user to easily grasp the interior handle of the drain plug to install and uninstall the drain plug by hand. This angle reduces the risk of the interior handle interfering with the hull of the boat, which would make it difficult to operate by hand.

In particular, the present application discloses a drain assembly, including a drain port and a drain plug. The drain port is adapted to be installed on a watercraft and includes a flange, a first neck portion extending from the flange, a second neck portion extending from the flange opposite the first neck portion, and a drain aperture extending through the first and second neck portions. The flange is adapted to be disposed adjacent to an exterior surface of a hull of the watercraft, and the first neck portion is adapted to be disposed in an aperture in the hull. The first and second neck portions are also angularly displaced relative to an axis extending through the flange.

The drain plug is adapted to engage the drain port and includes a shaft extending through the drain aperture, a first handle disposed on a first end of the shaft and adapted to be positioned on an interior side of the hull, and a second handle disposed on a second end of the shaft opposite the first handle and adapted to be positioned on an exterior side of the hull. The drain plug also includes an engagement portion disposed proximate to the second handle that is adapted to matingly engage the drain aperture in the second neck portion to form a substantially fluid tight seal.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
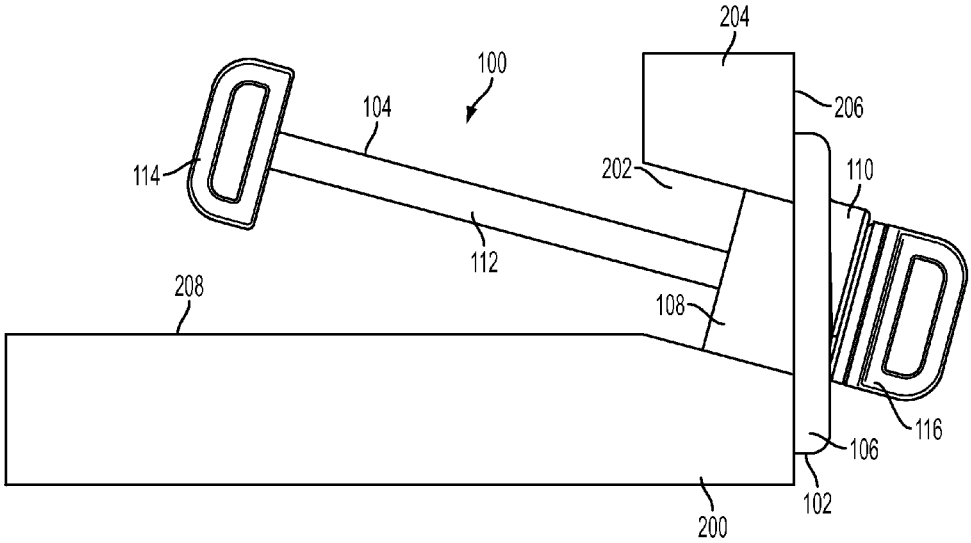
FIG. 1 is a side elevation view of an angled drain port and a drain plug installed in a typically hull of a boat according to an embodiment of the present application.

While the present invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated.

The present application discloses an angled drain port and drain plug adapted to be installed in a hull of a boat. In an embodiment, the drain plug includes a handle and can be opened/uninstalled and closed/installed from both interior and exterior sides of the boat. In another embodiment, the drain plug includes two opposing handles, one for access to the plug from the interior side of the boat, and the other for access to the plug from the exterior side of the boat. This provides a drain plug that can be operated to install or uninstall the drain plug from the exterior side of the boat, for example, when the boat is on a trailer, or from the interior side of the boat, for example, when the boat is on a lift or in the water. The size and shape of the handles may also prevent the drain plug from being lost or completely removed from the drain port because neither handle can pass through the opening of the drain port. The drain port may also be angled relative to a horizontal plane to provide for clearance between the first handle or interior handle of the drain plug and the hull of the boat to allow a user to easily grasp the interior handle of the drain plug to install and uninstall the drain plug by hand.

As illustrated in FIG. 1, an angled drain port and drain plug assembly 100 includes a drain port 102 and a drain plug 104. The drain port 102 includes a flange 106 adapted to abut the exterior surface of the boat, an interior neck 108 or first neck portion extending from an interior side of the flange 106, and an exterior neck 110 or second neck portion extending from an exterior side of the flange 106. The interior neck 108 and the exterior neck 110 include an opening or aperture (illustrated in FIG. 4 as drain aperture 124) extending through the drain port 102 to allow water and other fluid to pass through the drain port 102, when the drain port 102 is open.

The drain plug 100 includes an axial shaft 112, an interior handle 114 or first handle on a first end of the shaft 112, and an exterior handle 116 or second handle on a second end of the shaft 112 opposite the interior handle 114. The drain plug 104 mates with the drain port 102 to plug or seal the drain port 102 and substantially prevent water from passing through the drain port 102 when the drain plug 104 is installed in the drain port 102, as illustrated in FIG. 1.

The drain port 102 and the drain plug 104 may be installed in a hull 200 of a typical boat. For example, the drain port 102 is installed in an aperture 202 extending through a transom 204 of the boat. As illustrated in FIG. 1, the interior neck 108 of the drain port 102 extends into the aperture 202 and the flange 106 is abuts an exterior surface 206 of the transom 204 of the boat. In an embodiment, the drain port and drain plug assembly 100 is installed in the hull of the boat adjacent to the lowest area of the boat floor surface 208 where water will collect the most and can thus be drained from the boat.

The interior neck 108 and the exterior neck 110 may be angled relative to the flange 106, and the aperture 202 may also be angled to accommodate the interior neck 108. For example, the interior neck 108 and the exterior neck 110 may be angled about 5 degrees to about 80 degrees out of perpendicular alignment with the flange 106, inclusive of all ranges and sub-ranges therebetween. This provides clearance between the interior handle 114 and an boat floor surface 208 of the hull 200 of the boat. This angle and clearance allows a user to grasp the interior handle 114 to install or uninstall the drain plug 104 from the drain port 102, without the interior handle 114 interfering with the boat floor surface 208 of the hull 200, which would make it difficult to grasp and operate the interior handle 114.

Figure 2:
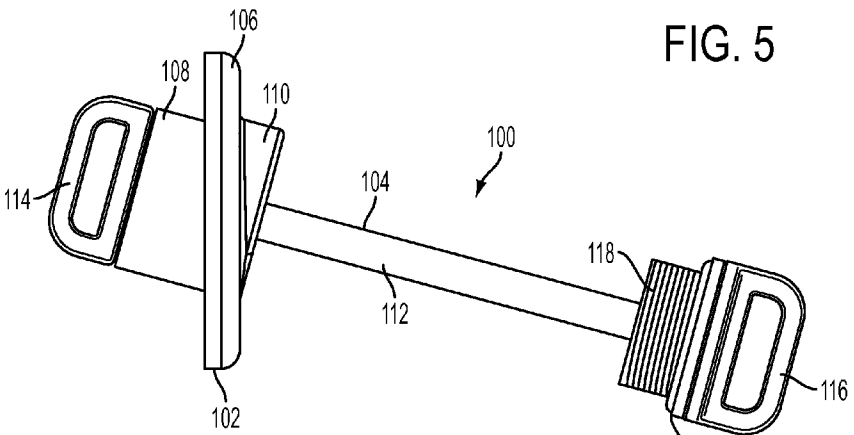
FIG. 2 is a side elevation view of the drain plug uninstalled in the drain port according to an embodiment of the present application.

As illustrated in FIG. 2, the drain plug 104 is uninstalled from the drain port 102, and the drain port 102 is open to allow water or other fluid to flow through the drain port 102. As illustrated in FIG. 2, the drain plug 104 includes an engagement portion 118 disposed proximate to the exterior handle 116 and is adapted to mate with the exterior neck 110 of the drain port 102. As illustrated, the engagement portion 118 is a threaded engagement and is adapted to threadably engage with a corresponding threaded connection in the exterior neck 110 of the drain port 102 to close the drain port 102 and substantially prevent water or other liquid from flowing through the drain port 102.

The drain plug 104 may also include a seal 120 disposed proximate the exterior handle 116. The seal 120 is adapted to engage with or abut against the exterior neck 110 or the exterior side of the flange 106 of the drain port 102 to form a substantially fluid tight seal. The seal 120 may be adapted to compress against the drain port 102 to form the substantially fluid tight seal. The seal 120 may be in the form of an O-ring, or other sealing mechanism. Further, the seal 120 may be made of plastic, metal, rubber, polymers, or combinations thereof.

Figure 3:
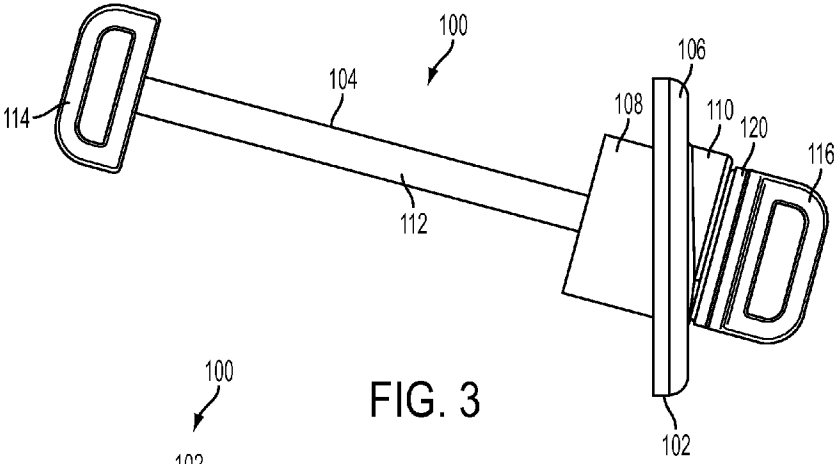
FIG. 3 is a side elevation view of the drain plug installed in the drain port according to an embodiment of the present application.

As illustrated in FIGS. 2 and 3, the drain plug 104 may be installed into the drain port 102, as illustrated in FIG. 3, and uninstalled from the drain port 102, as illustrated in FIG. 2. To install and uninstall the drain plug 104, a user rotates either of the interior handle 114 or the exterior handle 116. Upon rotation of either of the interior handle 114 or the exterior handle 116, the threaded connection 118 may be tightened into or loosened from threadable engagement with the drain port 102. This allows the user to install and uninstall the drain plug 104 from an exterior side of the hull 200 of the boat or an interior side of the hull 200 of the boat.

The ability of the drain plug 104 to be uninstalled and installed from an interior of the hull 200 also allows a user to uninstall and install the drain plug 104 while the boat is in the water, in the event the user accidentally forgets to install the drain plug 104 prior to placing the boat in the water. This also provides easy access to the drain plug 104 for the purpose of draining fluid from the bilge or bottom the boat when the boat is removed from the water and placed on a lift or trailer.

Figure 5:
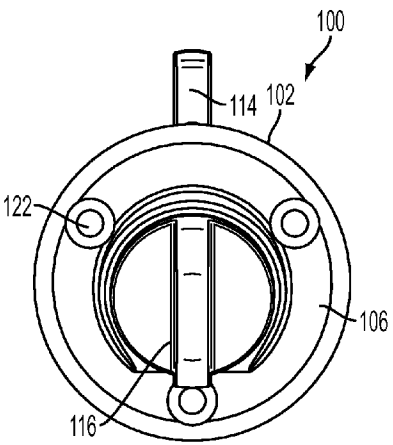
FIG. 5 is a top perspective view of the drain plug installed in the drain port according to an embodiment of the present application.
Figure 4:
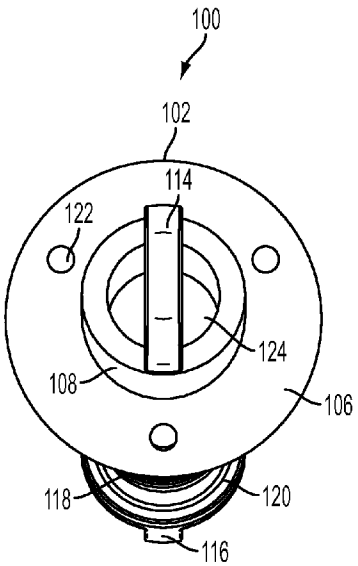
FIG. 4 is a top perspective view of the drain plug uninstalled in the drain port according to an embodiment of the present application.

As described above, the drain port 102 may be installed in the transom 204 or the hull 200 of the boat. As illustrated in FIGS. 4 and 5, the flange 106 of the drain port 102 may include one or more fastener apertures 122. The fastener apertures allow fasteners to be disposed through the flange 106 to fasten the drain port 102 to the transom 204 or other part of the hull 200 of the boat. It will be appreciated that one or more sealing agents or mechanisms may also be disposed between the flange 106 and the transom 204 or other part of the hull 200 to provide a substantially fluid tight seal.

As illustrated in FIGS. 1-5, the interior and exterior handles 114 and 116 may be sized and shaped to prevent the interior and exterior handles 114 and 116 from passing through a drain aperture 124, illustrated in FIG. 4, of the drain port 102. This prevents the drain plug 104 from being completely removed from the drain port 102, thereby preventing the drain plug 104 from being lost or otherwise misplaced. The misplacing of drain plugs is common among boat owners. These drain plugs are also routinely left uninstalled during storage of the boat, for example, to prevent rain water from accumulating when the boat is stored outside. Boat owners frequently misplace or cannot find the drain plug. However, the present drain plug 104 remains in the drain port at all times, even when uninstalled. Thus, the risk of misplacing or losing the drain plug 104 is significantly nullified.

The drain plug 104, including the shaft 112, the connection 118, and the interior and exterior handles 114 and 116, may be integrally formed, monolithically formed, or machined from a single piece of, for example, metal, plastic, or other suitable material. Similarly, the drain port 102, including the flange 106 and the interior and exterior neck portions 108 and 110, may be integrally formed, monolithically formed, or machined from a single piece of, for example, metal, plastic, or other suitable material.

One or both of the interior and exterior handles 114 and 116 may be removable from the shaft 112 to allow the drain plug 104 to pass through the drain aperture 124 of the drain port 102. This may facilitate complete removal and replacement of the drain plug 104 from the drain port in the event the drain plug 104 becomes damaged or otherwise needs to be replaced or removed.

As described above, the drain plug 104 mates with the drain aperture 124 in the drain port 102 via a threading engagement. However, the drain plug 104 and drain port 102 may utilize additional or alternative engagement mechanisms capable of providing a substantially fluid tight seal. For example, a compression engagement may be used in which the drain plug includes a material that is compressed causing the material to expand in the drain aperture 124 to provide a substantially fluid tight seal.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A drain assembly for a watercraft having a hull with a hull aperture and an interior hull side having an interior hull surface and an exterior hull side having an exterior hull surface, the drain assembly comprising:

a drain port including:

a flange adapted to be disposed adjacent to the exterior hull surface;

a first neck portion extending from the flange and adapted to be disposed in the hull aperture;

a second neck portion extending from the flange opposite the first neck portion; and a drain aperture having a drain aperture diameter and extending through the first and second neck portions; and a drain plug adapted to engage the drain port, the drain plug including:

a shaft having opposing first and second shaft ends and extending through the drain aperture;

a first handle having a first handle width disposed on the first shaft end and adapted to be disposed on the interior hull side;

a second handle having a second handle width and disposed on the second shaft end and adapted to be disposed on the exterior hull side; and an engagement portion extending from the second handle and adapted to matingly engage the drain aperture in the second neck portion, wherein each of the first and second handle widths is each larger than the drain aperture diameter to prevent each of the first and second handles from passing through the drain aperture.

2. The drain assembly of claim 1, further comprising a seal disposed proximate to the second handle and adapted to compress against the second neck portion.

3. The drain assembly of claim 1, wherein the engagement portion includes engagement portion threads adapted to threadingly engage corresponding drain aperture threads disposed on the drain aperture.

4. The drain assembly of claim 1, wherein the first and second neck portions are each angularly displaced relative to the flange.

5. The drain assembly of claim 1, wherein the first and second neck portions are angularly disposed at an angle of about 5 to about 80 degrees relative to a perpendicular axis extending through the flange.

6. A drain plug, comprising:

a shaft having opposing first and second shaft ends;

a first handle having a first handle width disposed on the first shaft end;

a second handle having a second handle width disposed on the second shaft end; and an engagement portion disposed proximate to the second handle and adapted to matingly engage a drain aperture having a drain aperture diameter, wherein each of the first and second handle widths is larger than the drain aperture diameter to prevent each of the first and second handles from passing through the drain aperture.

7. The drain plug of claim 6, further comprising a seal disposed proximate to the second handle and adapted to compress against the drain port and provide a substantially fluid tight seal.

8. The drain plug of claim 6, wherein the engagement portion includes engagement portion threads.

9. The drain plug of claim 6, wherein the first and second handles are monolithically formed from a single piece with the shaft.

10. The drain plug of claim 6, wherein at least one of the first and second handles is removable from the shaft to allow removal of the drain plug from the drain port.

11. A drain port assembly for a watercraft having a hull with a hull aperture and an interior hull side having an interior hull surface and an exterior hull side having an exterior hull surface, the drain port assembly comprising:

a drain port including:

a flange adapted to be disposed adjacent to the exterior hull surface;

a first neck portion extending from the flange and adapted to be disposed in the hull aperture;

a second neck portion extending from the flange opposite the first neck portion; and a drain aperture extending through the first and second neck portions and having a drain aperture diameter; and a drain plug including:

a shaft having opposing first and second shaft ends and adapted to extend through the drain aperture;

a first handle having a first handle diameter coupled to the first shaft end;

a second handle having a second handle diameter coupled to the second shaft end; and an engagement portion extending from at least one of the first and second handles and adapted to matingly engage the drain aperture to close the drain aperture, wherein each of the first and second handle widths is larger than the drain aperture diameter to prevent each of the first handle and the second handle from passing through the drain aperture; and wherein the first and second neck portions are angularly disposed at an angle of about 5 to about 80 degrees relative to an axis extending through the flange.

12. The drain port assembly of claim 11, further comprising a fastener aperture disposed in the flange and adapted to receive a fastener for installing the drain port on the hull of the watercraft.

* * * * *